United States Patent [19]

Pracht

[11] Patent Number: 5,027,514

[45] Date of Patent: Jul. 2, 1991

[54] SCISSORS AND GRIP

[75] Inventor: Gunther Pracht, Solingen, Fed. Rep. of Germany

[73] Assignee: "Jaguar" Stahlwarenfabrik GmbH & Co. KG, Fed. Rep. of Germany

[21] Appl. No.: 581,350

[22] Filed: Sep. 13, 1990

[30] Foreign Application Priority Data

Oct. 12, 1989 [DE] Fed. Rep. of Germany ..... 3934104

[51] Int. Cl.[5] ..... B26B 13/20

[52] U.S. Cl. ..... 30/232; 30/298

[58] Field of Search ..... 30/231, 232, 296.1, 30/297, 298, 254, 256, 260

[56] References Cited

U.S. PATENT DOCUMENTS 1,519,816 12/1924 Ward ..... 30/298

4,742,617 5/1988 Gauvry ..... 30/232

*Primary Examiner*—Douglas D. Watts

*Attorney, Agent, or Firm*—Diller, Ramik & Wight

[57] ABSTRACT

In a pair of scissors, in particular hairdressers' scissors, which have an optionally usable hook serving as a finger support on one grip hole, an at least partially undercut groove is constructed for attaching the hook at the corresponding place in the grip hole, said attachment being simple and not impairing the usage of the scissors, into which groove the hook can be pushed with a guide part which is essentially complementary to the undercut groove. In this case, the pushing-in direction of the guide part preferably corresponds to the direction of the finger pressure, acting on the hook, of the user of the scissors.

9 Claims, 1 Drawing Sheet

SCISSORS AND GRIP

Figure 1:
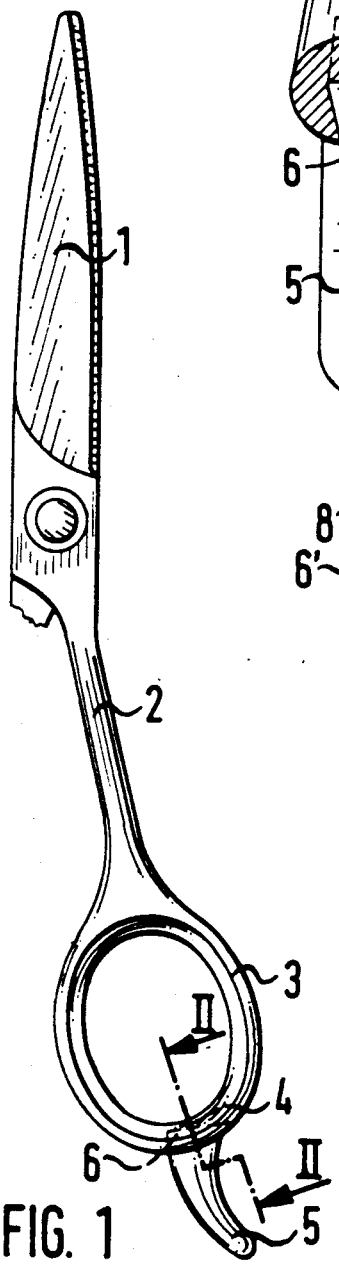

The invention relates to a pair of scissors, in particular hairdressers' scissors, which have an optionally usable hook serving as a finger support on one grip hole.

When operating the scissors, the little finger of the user's hand rests on the hook. Depending on the habit and individual desire of the user, scissors with or without a hook arranged on one grip hole are used. In order to allow the user an appropriate choice in one pair of scissors, it is expedient for the scissors to have a hook which can be attached to the respective grip hole. The individual user can consequently use the scissors as desired either with or without the hook.

A hook which can optionally be attached to the respective grip hole of the scissors not only has advantages for the user, but also for the storage of the corresponding scissors. As required, an available pair of scissors can be supplied either without the finger support or, after mounting the hook, as scissors with a finger support. By this means, storage which otherwise comprises one store of scissors with a finger support and one store of scissors without a finger support can be halved.

A pair of scissors of the type mentioned at the beginning is known from German Utility Model 8,604,659. With these scissors, the hook is formed by a screw which can be screwed with its threaded end in the grip hole of the scissors. By introduction of a threaded hole into the grip hole, the hook can be mounted on the scissors subsequently as required. On the other hand, by unscrewing the hook, e.g. by means of a coin inserted in the slot of the screw, the hook can be removed from the scissors.

However, a tool is required for mounting and for dismantling this hook formed by a screw. Moreover, the form of the hook is largely specified by the screw, with the result that the hook cannot have a shape with an optimally snug fit on the finger.

A different pair of scissors, in which the hook can be placed on top of the grip hole and in which the above-mentioned disadvantages can be avoided, is proposed in German Utility Model 8,703,303. With these scissors, the hook has a bow-shaped channel for pushing it onto the grip hole laterally. The channel surrounds the ring of the grip hole from the inside around the side facing away from the finger insertion side up to beyond the outside of the ring. The hook is secured against radial removal from the grip hole by the bow-shaped channel. In order to prevent a movement of the hook in the axial direction, the hook has a shoulder arranged on a flat bar, which shoulder can be mounted on an attachment device provided on the inside of the respective shaft of the scissors.

This push-on hook has the disadvantage that the bow-shaped channel reduces the opening of the grip hole with its inside wall, which can impair the usage of the scissors. Moreover, due to the inside wall projecting into the opening of the grip hole, there is no even curvature of the inside of the grip hole. This means that the opening does not adapt in an optimum manner to the user's finger penetrating the grip hole, with the result that pressure points can arise on the finger, in particular in prolonged usage.

Moreover, with the placed-on hook, the attachment, which consists of the bow-shaped channel, the shoulder arranged on the flat bar and the attachment device provided on the inside of the respective shaft of the scissors and interacting with the shoulder, is technically very complicated. For these reasons, the placed-on hook has not been a success in practice.

The underlying object of the present invention is to provide a pair of scissors of the type mentioned at the beginning, in which the hook does not impair the use of the scissors, can easily be mounted and dismantled and has a shape with a snug fit to the user's finger.

According to the invention, the object is achieved in that, at the place provided to attach the hook, the grip hole has at least one partially undercut groove, into which the hook can be pushed with a guide part which is essentially complementary to the undercut groove.

On the basis of the proposed design, the hook can be attached in the simplest manner and without a tool on the respective grip hole and can be detached again from the latter. The hook is not specified in its shape, so that it can be constructed in an ergonomic manner. Since the attachment of the hook neither extends to the inside of the grip hole nor goes beyond the normal dimension of a hook on the outside, the hook in no way at all impairs the usage of the scissors.

The grip hole of a pair of scissors according to the invention can be made of metal or of plastic. The hook can likewise consist of metal or plastic. However, it is preferably made of plastic. In both cases, favourable friction conditions arise such that the hook inserted in the grip hole is held in a stable manner. Otherwise, the scissors can be designed in any known manner.

In a preferred embodiment of the invention, the groove moulded into the grip hole extends in the circumferential direction of the grip hole. It then leads from the outside of the grip hole into the grip hole with an acute angle to the tangent. Due to the length of the groove and of the guide part thus possible, a particularly stable fit of the hook in the grip hole is achieved.

The pushing-in direction of the guide part into the groove expediently corresponds to the direction of the user's finger pressure acting on the hook. In this embodiment, the finger pressure contributes towards the fact that the guide part in the groove cannot become detached during usage of the scissors.

For a further improvement of the attachment of the guide part in the groove, the groove can be constructed at least partially conically in the pushing-in direction. The conical form of the groove guarantees a firm clamping fit of the guide part which is further reinforced by the finger pressure exerted on the hook during usage of the scissors.

On the other hand or additionally, the guide part of the hook can also be constructed at least partially conically in the pushing-in direction. The form of the undercutting of the groove can be of any suitable type. A particularly simple design is an at least partially dovetail-shaped cross section of the groove. The likewise dovetail-shaped guide part of the groove is preferably of conical construction in the pushing-in direction and dimensioned in such a way that a particular pressure is required for pushing in which ensures a firm clamping fit. The lateral pressure of the guide part on the dovetail-shaped groove must not, however, be too great in order to avoid an undesired outward expansion of the edges of the groove.

In another simple design, the groove can have an at least partially T-shaped cross section. In the then likewise T-shaped guide part, preferably only the girth is of conical construction whereas the bar has parallel side walls. In this embodiment, the lateral pressure forces of the conically designed girth act in the centre of the corresponding part of the grip hole. On the outwardly facing side, no significant pressure is exerted on the side walls of the groove due to the parallel side walls of the bar. This means that an undesired expansion of the groove is avoided when pushing in the guide part.

In order to avoid an impairment of the usage of the scissors due to the open groove when the hook has been removed, a blank matched to the guide part of the hook is provided, which blank ends flush with the outside of the grip hole when it is pushed into the groove.

Figure 2A:
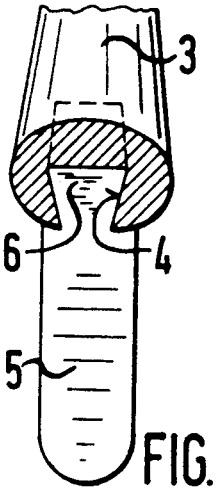
Figure 2B:
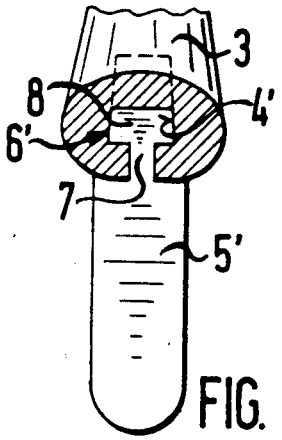
Figure 4:
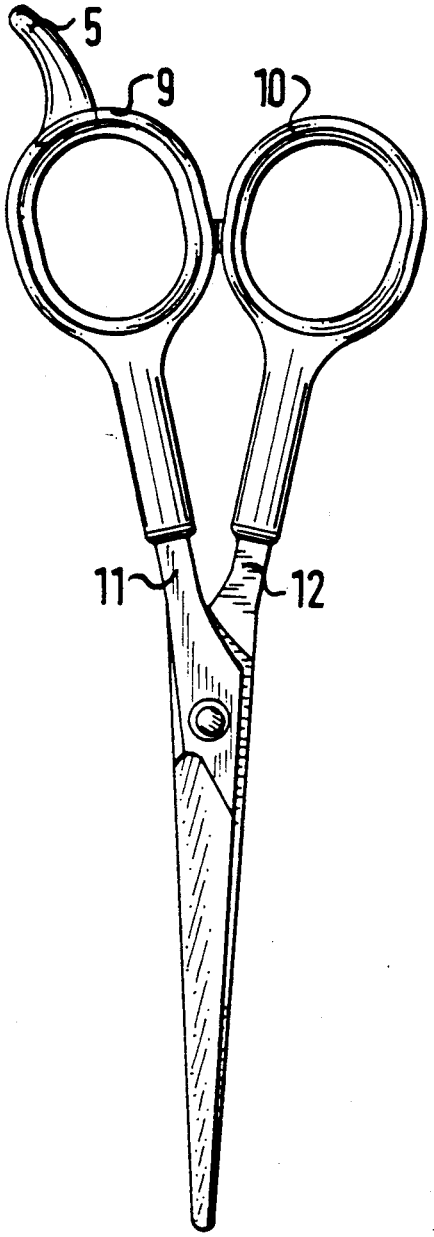
Figure 3:
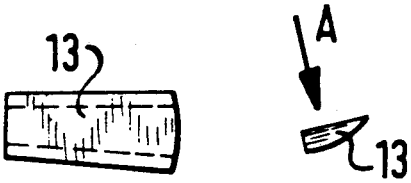

Some exemplary embodiments of the invention are described in greater detail below with reference to the drawing, in which:

FIG. 1 shows a partial view of a pair of scissors with the hook inserted in the corresponding grip hole, FIG. 2*a* shows a section along the line II—II in FIG. 1 with an exemplary embodiment of the hook, FIG. 2*b* shows a section along the line II—II in FIG. 1 with another exemplary embodiment of the hook, FIG. 3 shows a lateral view of a blank on the right side of the Figure and an enlarged plan view of the blank in the direction of the arrow A on the left side of the Figure and FIG. 4 shows a view of a further embodiment of the scissors.

The scissors illustrated in FIG. 1 have on the shaft 2 connected to the blade 1 a grip hole 3 which is moulded integrally to the shaft 2 and consists of metal. On the outside facing away from the shaft 2, an undercut groove 4 is moulded into the grip hole 3. The groove 4 extends in the circumferential direction of the grip hole 3 in a straight line from its outside into the grip hole 3 in an acute angle in relation to the tangent.

Inserted in the groove 4 is a hook 5 with a guide part 6 which is complementary to the undercut groove 4. The pushing-in direction of the guide part 6 corresponds to the direction of the finger pressure acting on the hook 5 of the user of the scissors.

Two particularly simple and expedient cross-sectional forms of the undercut groove 4 and the guide part 6 complementary thereto are illustrated in FIGS. 2*a* and 2*b*.

The groove 4 shown in FIG. 2*a* has a dovetail-shaped cross section. The width of the groove 4 is approximately constant over its entire length. The guide part 6 likewise has a dovetail-shaped cross section. The guide part 6 is of conical construction in the pushing-in direction. The width of the guide part 6 is slightly greater on the side opposing the pushing-in direction than the width of the groove 4, with the result that a firm clamping fit of the guide part 6 pushed into the groove 4 results.

In the exemplary embodiment shown in FIG. 2*b*, the groove 4' and the guide part 6' of the hook 5' have a T-shaped cross section. The cross-sectional width is constant over the entire length of the groove 4'. In the guide part 6', the width of the bar 7 is likewise constant, whereas the girth 8 is of conical construction in the pushing-in direction. The width of the girth 8 is, in turn, slightly greater on the side opposing the pushing-in direction than the width of the groove 4', which means that a firm clamping fit of the guide part 6' pushed into the groove 4' results.

The hooks 5 and 5' of the two exemplary embodiments considered above are made of plastic. Due to the good friction conditions of the plastic used for the hooks 5 and 5' and of the metal used for the grip hole 3, a stable fit of the guide part 6 and 6' in the groove 4 and 4' respectively is guaranteed. The hook 5 and 5' thus forms a stable resting surface for the user's finger.

FIG. 4 illustrates another exemplary embodiment of a pair of scissors, the grip holes 9 and 10 being made of plastic and being placed firmly onto the associated shafts 11 and 12 of the scissors. The hook 5 with the guide part 6 and the groove 4 moulded into the grip hole 9 have no differences compared with the exemplary embodiment shown in FIG. 1. The clamping fit between the hook 5 made of plastic and the grip hole 9 provides a similarly stable fit to the clamping fit described above between the hook 5 and 5' consisting of plastic and the grip hole 3 made of metal.

Furthermore, in order to be able to close the groove 4 when the hook 5 is not used, a blank 13 is provided which can be pushed into the groove 4. The blank 13 is matched to the dovetail-shaped design of the guide part 6 and, when pushed into the groove 4, ends flush and aligned with the outside of the grip hole 3. The scissors illustrated in FIGS. 1 and 4, together with the hook 5 and blank 13, are supplied as a set. Depending on whether the scissors are to be used without hook 5 or with hook 5, the blank 13 of the hook 5 is pushed into the groove 4.

List of reference numerals

1: Blade
2: Shaft
3: Grip hole
4: Groove
4': Groove
5: Hook
5': Hook
6: Guide part
6:40 : Guide part
7: Bar
8: Girth
9: Grip hole
10: Grip hole
11: Shaft
12: Shaft
13: Blank

What is claimed is:

1. Scissors, in particular hairdressers' scissors, which have an optimally usable hook serving as a finger support on one grip hole, characterized in that, at the place provided to attach the hook (5; 5'), the grip hole (3; 9) has at least one partially undercut groove (4; 4'), into which the hook (5; 5') can be pushed with a guide part (6; 6') which is essentially complementary to the undercut groove (4; 4').

2. Scissors according to claim 1, characterized in that the groove (4; 4') extends in the circumferential direction of the grip hole (3; 9).

3. Scissors according to claim 2, characterized in that the pushing-in direction of the guide part (6; 6') into the groove (4; 4') corresponds to the direction of the finger pressure acting on the hook (5; 5').

4. Scissors according to claims 1 to 3, characterized in that the undercut groove is at least partially of conical construction in the pushing-in direction.

5. Scissors according to one of claims 1 to 3, characterized in that the guide part (6; 6') of the hook (5; 5') is at least partially of conical construction in the pushing-in direction.

6. Scissors according to one of claims 1 to 5, characterized in that the undercut groove (4) and the guide part (6) have an at least partially dovetail-shaped cross section.

7. Scissors according to one of claims 1 to 5, characterized in that the undercut groove (4') and the guide part (6') have an at least partially T-shaped cross section.

8. Scissors according to claims 5 to 7, characterized in that the girth (8) of the T-shaped guide part (6') is at least partially of conical construction.

9. Scissors according to one of claims 1 to 8, characterized in that a blank (13) matched to the guide part (6) of the hook (5) is provided.

* * * * *